United States Patent [19]

Brown

[11] Patent Number: 4,602,389

[45] Date of Patent: Jul. 29, 1986

[54] HEM RETAINER

[76] Inventor: Barbara Brown, 1947 Wareham St., South Middleboro, Mass. 02043

[21] Appl. No.: 652,275

[22] Filed: Sep. 20, 1984

[51] Int. Cl.[4] ..... A41D 27/24

[52] U.S. Cl. ..... 2/243 R; 2/269; 2/232; 223/74

[58] Field of Search ..... 2/243 R, 227, 231, 232, 2/269; 223/63, 72, 74

[56] References Cited

U.S. PATENT DOCUMENTS

| | | | |
|---|---|---|---|
| 586,402 | 7/1897 | Tredway | 2/232 |
| 2,630,252 | 3/1953 | Ottoson | 223/74 |
| 3,097,364 | 7/1963 | Hess | 2/243 R X |
| 3,137,863 | 6/1964 | Dimpfl | 2/232 |
| 3,328,809 | 7/1967 | Payne et al. | 2/269 |
| 3,411,160 | 11/1968 | Le Roux et al. | 2/232 |

*Primary Examiner*—Werner H. Schroeder
*Assistant Examiner*—J. L. Olds

[57] ABSTRACT

This invention is directed at a hem retainer comprising a strip of flexible material which has a series of first and second engagement portions. At least one of the first engagement portions is engageable with at least one of the second engagement portions to hold the strip of flexible material in a circular configuration.

This invention is also directed at a method of forming a cuff on a pant leg or the like, the pant leg having an inside surface, an outside surface and an opening. The operator first measures the desired length of the pant leg, turns the pant leg inside out and then turns the excess length of the leg back on the inside surface of the pant leg. The hem retainer of the instant invention is formed into a circular configuration which is then inserted within the pant leg, adjacent the opening stretching the pant leg around the hem retainer by adjusting the circumference of the hem retainer. The operator can then sew the excess pant length to the inside surface of the pants leg forming a cuff.

1 Claim, 4 Drawing Figures

HEM RETAINER

BACKGROUND OF THE INVENTION

This invention relates generally to a method of forming a hem and more specifically to the use of a unique fexible hem retainer to form a pant cuff or the like.

SUMMARY OF THE INVENTION

This invention is directed at a hem retainer comprising a strip of flexible material which has a series of first and second engagement portions. At least one of the first engagement portions is engageable with at least one of the second engagement portions to hold the strip of flexible material in a circular configuration.

This invention is also directed at a method of forming a hem on a pants leg or the like, the pants leg having an inside surface, an outside surface and an opening. The operator first measures the desired length of the pant leg, turns the pant leg inside out and then turns the excess length of the leg back on the inside surface of the pant leg. The hem retainer of the instant invention is formed into a circular configuration which is then inserted within the pant leg, adjacent the opening stretching the pants leg around the hem retainer by adjusting the circumferance of the hem retainer. The operator can then sew the excess pant length to the inside surface of the pants leg forming a cuff.

BRIEF DESCRIPTION OF THE DRAWINGS

Further details are explained below with the help of the examples illustrated in the attached drawings in which:

FIG. 3 is front elevational view of a pair of pants, turned inside out, showing the hem retainer shown in FIG. 1 dotted in.

DESCRIPTION OF THE PREFERRED EMBODIMENT(S)

Figure 1:
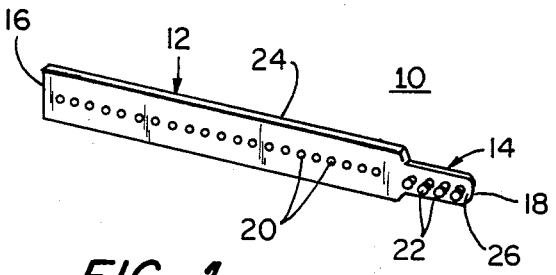
FIG. 1 is an isometric view of a hem retainer according to the present invention, open.
Figure 2:
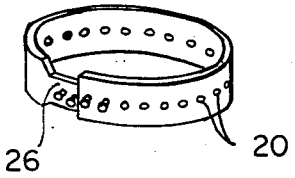
FIG. 2 is an isometric view of the hem retainer shown in FIG. 1, held in a circular configuration.
Figure 3:
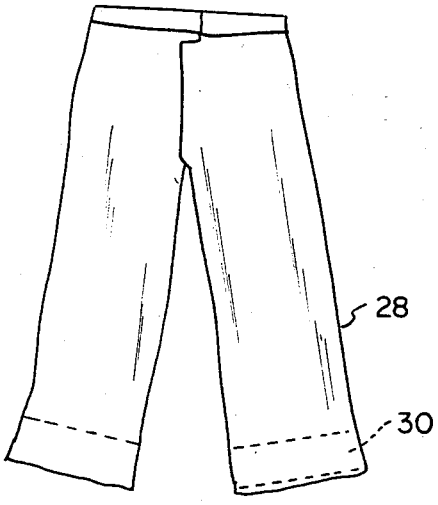

There is shown in the drawings a hem retainer 10 comprising a rectangular strip of flexible material such as a plastic. The hem retainer 10 includes a first section 12 and a second section 14. The second section 14 extends in integral relation from the first section 12 which has a first terminal end 16. The second section 14 includes a second terminal end 18. The first terminal end 16 and the second terminal end 18 provide the two ends of the hem retainer 10. The first section 12 has a series of first engagement portions 20 formed therein and the second section 14 has a series of second engagement portions 22 formed therewith. The first engagement portions 20 are spaced from each other and are aligned along the longitudinal axis of the hem retainer 10 as are the second engagement portions 22. The first section 12 has an inner surface 24 and the second section 14 has an outer surface 26. When the hem retainer is bent into a circular configuration, with the inner surface 24 facing toward the area defined by the circle, one or more of the first engagement portions 20 is engaged with one or more of the second engagement portions 22 holding the hem retainer 10 in the configuration. The first engagement portions 20 may be through apertures, as shown in the dawings of the instant application or may be the female member of a snap fastener pair, for example. The second engagement portions 22 may be headed studs, as shown in the drawings of the instant application or may be the male members of a snap fastener pair, for example.

Figure 4:
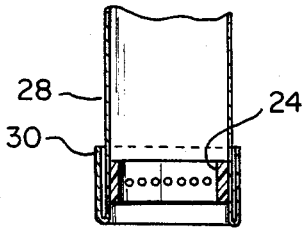
FIG. 4 is a section of a pant leg shown in FIG. 3.

The hem retainer 10 may be used to cuff a pair of pants for example. The operator turns the pant leg 28 inside out, as shown in FIG. 4. The excess material 30 is then turned up around the pant leg 28, a predetermined distance, as indicated in FIG. 4. This distance is determined by the proposed length of the pant leg 28. The hem retainer 10 is bent into a circular configuration and is held in that configuration by the engagement of one or more of the second engagement portions 22 with one or more of the first engagement portions 20 holding the hem retainer 10 in the circular configuration. The diameter of the circle, formed by the hem retainer 10 is adjusted to fit snugly within the pant leg 28 whereby the pant leg 28 in the area engaged by the hem retainer 10 is urged outwardly holding the pant leg 28 in a dilated position with the excess material 30 smoothly abutting the remaining pant leg 28. The operator can now sew the cuff without puckering the material. After the cuff is finished, the hem retainer 10 is slid out of the pant leg 28.

What is claimed is:

1. A method of forming a hem on a pants leg or the like, the pants leg having an inside surface, an outside surface, an excess length and an opening, the method including the steps of: a (a) turning the pants leg inside out, (b) turning the excess length of the leg back on the inside surface of the pants leg, (c) inserting a circular hem retainer within the pants leg, adjacent the opening against the outside surface of the pants leg, (d) stretching the pants leg around the hem retainer by adjsuting the circumferance of the hem retainer, (e) sewing the excess pants length to the inside surface of the pants leg, (f) whereby a cuff is formed on the pants leg.

* * * * *